US006341412B1

(12) United States Patent
Romann et al.

(10) Patent No.: US 6,341,412 B1
(45) Date of Patent: Jan. 29, 2002

(54) METHODS OF FORMING A SHEATH AND PLASTIC RING ON A ELECTROMAGNETICALLY OPERATED VALVE

(75) Inventors: Peter Romann, Stuttgart; Ferdinand Reiter, Markgroeningen, both of (DE); Rudolf Babitzka, Bologna (IT)

(73) Assignee: Robert Bosch GmbH, Stuttgart (DE)

( * ) Notice: Subject to any disclaimer, the term of this patent is extended or adjusted under 35 U.S.C. 154(b) by 887 days.

(21) Appl. No.: 08/975,469

(22) Filed: Nov. 21, 1997

Related U.S. Application Data

(60) Continuation of application No. 08/238,085, filed on May 4, 1994, now abandoned, which is a division of application No. 08/079,581, filed on Jun. 22, 1993, now abandoned, which is a division of application No. 07/915,991, filed on Aug. 3, 1992, now Pat. No. 5,275,341.

(30) Foreign Application Priority Data

Feb. 3, 1990 (DE) ..... 40 03 228
Jun. 21, 1991 (WO) ..... PCT/DE91/00050

(51) Int. Cl.[7] ..... H01F 41/02

(52) U.S. Cl. ..... 29/602.1; 264/272.19

(56) References Cited

U.S. PATENT DOCUMENTS 4,610,080 A * 9/1986 Hensley ..... 29/602.1

* cited by examiner

*Primary Examiner*—Carl E. Hall
(74) *Attorney, Agent, or Firm*—Ronald E. Greigg

(57) ABSTRACT

In electromagnetically operable valves which have been proposed, having a fuel inlet connecting piece which is surrounded by a magnet coil and is used as a core, at least a part of the valve is surrounded by a plastic sheath on which an electrical connecting plug is integrally formed. However, different valve extrusion coating tools are required depending on the embodiment of the electrical connecting plug. In the valve, the electrical connecting plug (21) is injection moulded at the same time as the extrusion coating of the magnet coil (4) and thus forms an independent plastic injection molding. Only one valve extrusion coating tool is now required for different embodiments of the electrical connecting plug, resulting in greater flexibility in the assembly line. The valve is used as an injection valve for fuel injection systems.

10 Claims, 2 Drawing Sheets

Figure 1:
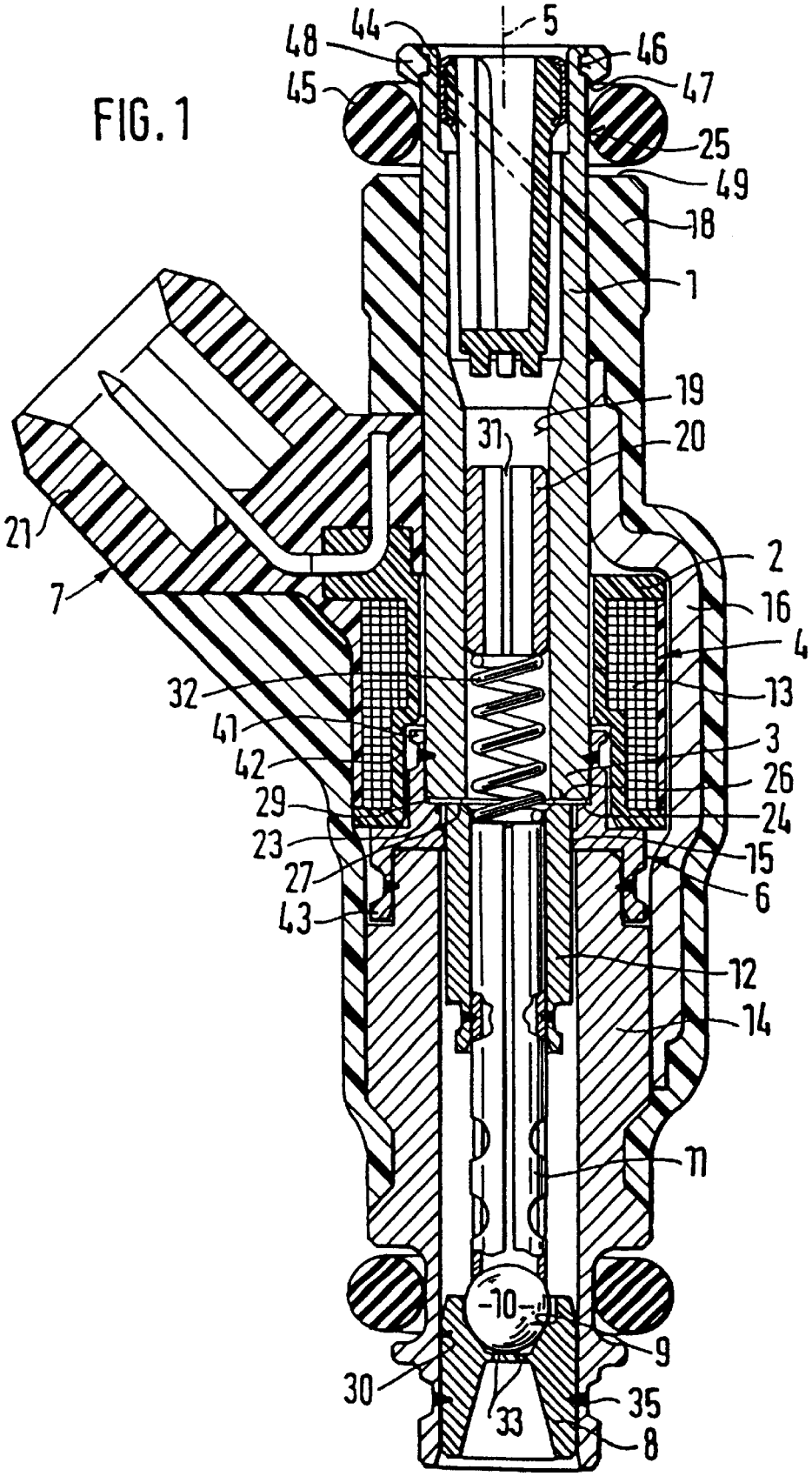

METHODS OF FORMING A SHEATH AND PLASTIC RING ON A ELECTROMAGNETICALLY OPERATED VALVE le;.5q le;.5qThis application is a continuation of application Ser. No. 08/238,085 filed May 4, 1994 now abandoned, which is a division of Ser. No. 08/079,581 filed Jun. 22, 1993, abandoned, which is a division of Ser. No. 07/915,991 filed Aug. 3, 1992, now U.S. Pat. No. 5,275,341.

PRIOR ART le;.5qThe invention is based on an electromagnetically operable valve as set forth hereinafter.

le;.5qAn electromagnetically operable valve has already been proposed in Patent Application P 38 25 135.3 U.S. Pat. No. 4,967,666, in which at least a part of the valve is surrounded by a plastic sheath, and on which an electrical connecting plug is integrally formed. However, different valve extrusion coating tools are required depending on the embodiment of the electrical connecting plug. This prevents cost-effective, flexible assembly.

ADVANTAGES OF THE INVENTION le;.5qThe valve according to the invention has the advantage of simple production and assembly which permits cost-effective mass production since only a single valve extrusion coating tool is required for the different embodiments of the electrical connecting plug. As a consequence, this results in greater flexibility during assembly. Good handling capability of the plastic injection moulding, which consists of the magnet coil and the electrical connecting plug, can be named as a further advantage.

le;.5qIt is particularly advantageous to provide on the circumference of the inlet-side end of the fuel inlet connecting piece an annular groove whose radially extending side surfaces are formed by the plastic sheath surrounding a part of the valve, and whose groove base is formed by the circumference of the fuel inlet connecting piece.

le;.5qIt is also advantageous if an axial gap, in which there is arranged, by clamping-in, a non-magnetic stop plate which forms a residual air gap between the inlet-side end of the armature and the core end and which bounds the movement of the valve closing body during the valve opening process, is formed between the end surface of the core end facing the armature and a shoulder of the intermediate part.

le;.5qIt is likewise advantageous if the fuel inlet connecting piece exhibits a constant external diameter over its entire length.

le;.5qIt is particularly advantageous if the cylindrical valve seating body exhibits a constant external diameter.

le;.5qA valve having the features set forth herein makes possible a compact, short structural shape of the valve.

DRAWING le;.5qAn exemplary embodiment of the invention is shown in simplified form in the drawing and is explained in more detail in the following description.

le;.5qFIG. 1 shows an exemplary embodiment of a valve designed according to the invention, and le;.5qFIG. 2 shows the independent plastic injection moulding which consists of the magnet coil and the electrical connecting plug.

Figure 2:
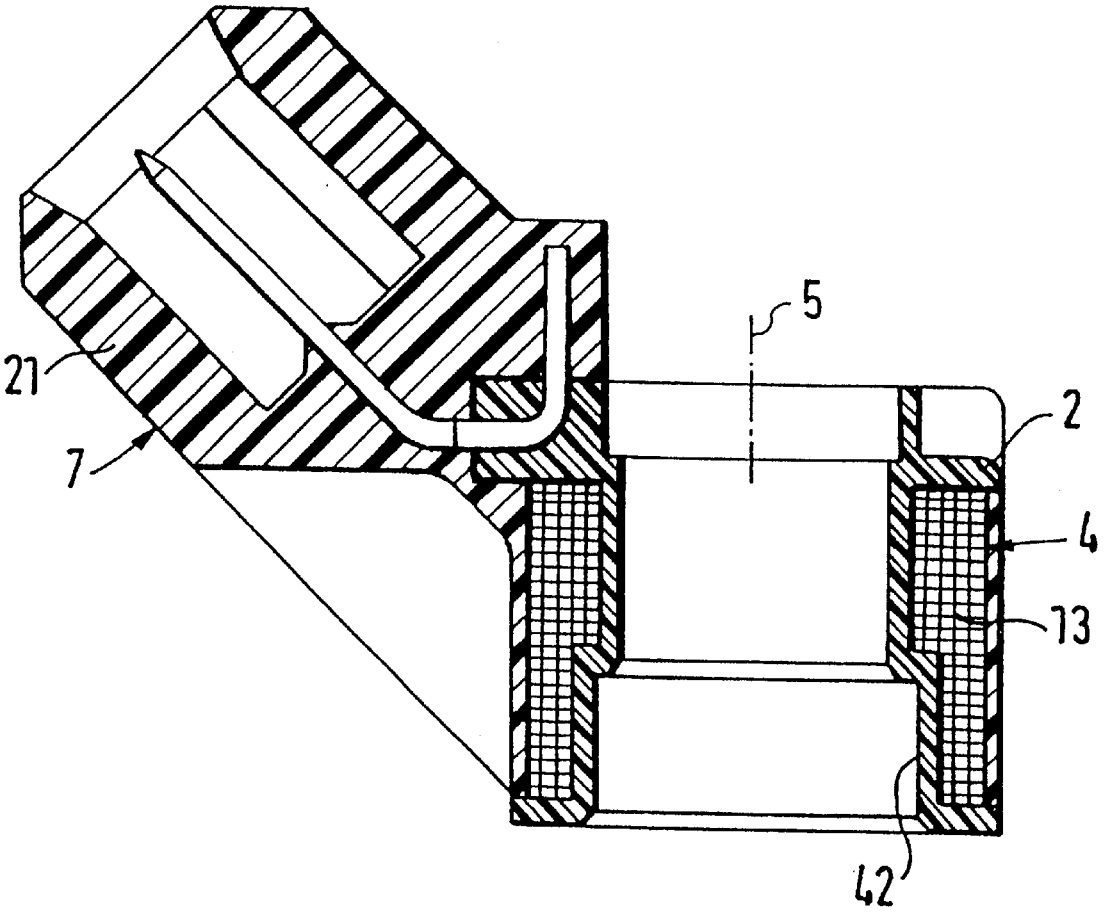

DESCRIPTION OF THE EXEMPLARY EMBODIMENT le;.5qThe electromagnetically operable valve, which is shown by way of example in FIG. 1, in the form of an injection valve for fuel injection systems of internal-combustion engines has a fuel inlet connecting piece 1, which is surrounded by a magnet coil 4, is used as a core and exhibits a constant external diameter, constructed for example by means of centreless grinding, over its entire length in order to make use of the space as well as possible. The magnet coil 4, having a coil former 2, is provided, as is shown in FIG. 2, with a plastic extrusion coating 7, an electrical connecting plug 21 being injection moulded at the same time, so that an independent plastic injection moulding is produced which contains the magnet coil 4 and the connecting plug 21. The magnet coil 4, which in the radial direction exhibits a stepped coil former 2 having a winding 13 which is stepped in the radial direction, in conjunction with the fuel inlet connecting piece 1, which exhibits a constant external diameter, makes possible a short and compact construction of the injection valve, as is explained in the following text.

le;.5qA tubular metallic intermediate part 6 is closely connected to a lower core end 3 of the fuel inlet connecting piece 1, concentrically with respect to a valve longitudinal axis 5, by welding, and at the same time engages partially axially around the core end 3 by means of an upper cylindrical section 41. The stepped coil former 2 engages partially around the fuel inlet connecting piece 1 and, by means of a step 42 having a larger diameter, a cylindrical section 41 of the intermediate part 6. At its end facing away from the fuel inlet connecting piece 1, the intermediate part 6 is provided with a lower cylindrical section A33 which engages around a tubular connecting part 14 and is closely connected thereto by welding. A cylindrical valve seating body 8 is closely mounted into the downstream end of the connecting part 14 by welding. The arrangement in a row of the fuel inlet connecting piece 1, the intermediate part 6, the connecting part 14 and the valve seating body 8 thus represents a rigid metallic unit. The valve seating body 8 exhibits a constant external diameter, constructed for example by means of centreless grinding, so that the valve seating body 8 can be inserted completely into the connecting part 14 and improved sealing between the valve seating body 8 and the internal hole 30 in the connecting part 14 is achieved by means of the longer overlap.

le;.5qAn adjusting sleeve 20, which is pushed into a flow bore 19 in the fuel inlet connecting piece 1, exhibits a slot 31 in the longitudinal direction, and is formed for example out of rolled spring-steel sheet, is used for adjusting the spring pretensioning of a restoring spring 32 which abuts against the adjusting sleeve 20 and is supported downstream on a connecting pipe 11. A tubular armature 12, which is guided by a guide collar 15 of the intermediate part 6, is connected by welding to the end of the connecting pipe 11 facing the restoring spring 32. A valve closing body 10, which interacts with the valve seat 9 of the valve seating body 8 and is constructed for example as a ball, is connected to the connecting pipe 11 by soldering or welding, at the other end of said connecting pipe 11. At least one spray opening 33, formed for example by erosion, is constructed downstream from the valve seat 9 in the valve seating body 8. The welded seam 35 between the valve seating body 8 and the connecting part 14 is at a relatively large distance from the spray opening or openings 33 and from the valve seat 9, so that an effect on the flow quantity and lack of sealing resulting from warping of the valve seating body 8 as a consequence of the high temperatures occurring during welding are effectively prevented.

le;.5qAn axial gap 29 in which there is arranged, by clamping-in, a non-magnetic stop plate 27 which forms a residual air gap between the inlet-side end 26 of the armature 12 and the end surface 23 of the core end 3 and which bounds the movement of the valve closing body 10 during the valve opening process, is formed between the end surface 23 of the core end 3 facing the armature 12 and a shoulder 24, which leads to the upper cylinder section 41, of the intermediate part 6. Because of its relatively high bending stiffness, the clamped stop plate 27 protects the end surface 23 of the core end 3 against wear better than a loose plate, in which there is a risk of tilting or of stopping unevenly.

le;.5qThe magnet coil 4 is surrounded by at least one, guide element 16 which is constructed as a clip in the exemplary embodiment, is used as a ferromagnetic element, extends over the entire length of the magnet coil 4 in the axial direction, and at least partially surrounds the magnet coil 4 in the circumferential direction, and abuts against the fuel inlet connecting piece 1 at its one end and against the connecting part 14 at its other end, and is connected to said connecting piece 1 and connecting part 14 for example by welding.

le;.5qThe fuel inlet connecting piece 1 is provided with a retaining groove 46 close to the inlet end. A part of the valve is surrounded by a plastic sheath 18 which extends axially, originating from the fuel inlet connecting piece 1. An annular plastic ring 48 is formed in the retaining groove 46 by the plastic sheath and the plastic sheath extends over the magnet coil 4 with the connecting plug 21 and the at least one guide element 16 and, at the same time, forms radially extending side surfaces of an annular groove 25 which is provided on the circumference of the inlet-side end 44 of the fuel inlet connecting piece 1 between one side surface 47 of the plastic ring 48 and a radially extending side surface 49 formed by an upper end of the plastic sheath 18. The groove base of the annular groove 25 exhibits, for example, a sealing ring 45 which is retained between the side surfaces 47 and 49 of the retaining ring 48 and the radially extending side surface of the plastic sheath 18, respectively.

le;.5qThe described plastic extrusion coating 7 of the magnet coil 4, in conjunction with the connecting plug 21 which is injection moulded at the same time, permits high flexibility during assembly of valves of different construction, since only one extrusion coating tool is required to produce the plastic sheath 18 for connecting plugs 21 and magnet coils 4 of different design. The magnet coil 4, which exhibits the coil former 2 which is stepped in the radial direction with the winding 13 which is stepped in the radial direction, makes possible a compact and short structural shape of the valve, in that said coil overhangs the upper cylindrical section 41 of the intermediate part 6 and hence produces an agglomeration of the individual parts.

le;.5qThe foregoing relates to a preferred exemplary embodiment of the invention, it being understood that other variants and embodiments thereof are possible within the spirit and scope of the invention, the latter being defined by the appended claims.

What is claimed is:

le;.5q1. A method of forming a plastic sheath on an electromagnetic valve and an annular plastic ring in a retaining groove in an inlet end of said electromagnetic valve which comprises assembling said electromagnetic valve to include a fuel inlet connecting piece (1) which protrudes from one end and includes said retaining groove in a circumference of the inlet end (44), and a magnet coil (4) electrically connected to a connecting plug (21), the method comprising forming an annular plastic ring in said retaining groove, forming a plastic sheath to surround at least a portion of said electromagnetic valve which covers substantially the entire length of said fuel inlet connecting piece toward its inlet end, forming radially extending side surfaces (47, 49) of an annular groove (25) bordered between an upper end of said plastic sheath and said annular plastic ring.

le;.5q2. A method as set forth in claim 1, which includes forming said plastic ring in said retaining groove to have a circumference which is less than that of said plastic sheath.

le;.5q3. A method as set forth in claim 2, which includes placing a sealing ring in said annular groove (25) bordered between the upper end of the plastic sheath and the plastic ring.

le;.5q4. A method as set forth in claim 1, which includes:

forming the annular plastic ring in said retaining groove at the same time as the plastic sheath is formed to surround at least a portion of said electromagnetic valve which covers substantially the entire length of said fuel inlet connecting piece toward its inlet end.

le;.5q5. A method as set forth in claim 2, which includes:

forming the annular plastic ring in said retaining groove at the same time as the plastic sheath is formed to surround at least a portion of said electromagnetic valve which covers substantially the entire length of said fuel inlet connecting piece toward its inlet end.

le;.5q6. A method as set forth in claim 3, which includes:

forming the annular plastic ring in said retaining groove at the same time as the plastic sheath is formed to surround at least a portion of said electromagnetic valve which covers substantially the entire length of said fuel inlet connecting piece toward its inlet end.

le;.5q7. A method of forming a plastic sheath on an electromagnetic valve and an annular plastic ring in a retaining groove in an inlet end of said electromagnetic valve which comprises assembling said electromagnetic valve to include a fuel inlet connecting piece (1) which protrudes from one end and includes said retaining groove in a circumference of the inlet end (44), and a magnet coil (4) electrically connected to a connecting plug (21), the method comprising forming a plastic sheath to surround at least a portion of said electromagnetic valve which covers substantially the entire length of said fuel inlet connecting piece toward its inlet end, and at the same time forming said annular plastic ring in said retaining groove thereby forming at the same time radially extending side surfaces (47, 49) of an annular groove (25) bordered between an upper end of said plastic sheath and said plastic ring, said annular groove surrounding said fuel inlet connecting piece.

le;.5q8. A method as set forth in claim 7, which includes forming said plastic ring in said retaining groove to have a circumference which is less than that of said plastic sheath.

le;.5q9. A method as set forth in claim 8, which includes placing a sealing ring in said annular groove (25) between the upper end of the plastic sheath and the plastic ring.

le;.5q10. A method of forming a plastic sheath on an electromagnetic valve and an annular plastic ring in a retaining groove in an inlet end of said electromagnetic valve which comprises assembling said electromagnetic valve to include a fuel inlet connecting piece (1) which protrudes from one end and includes said retaining groove in a circumference of the inlet end (44), and a magnet coil electrically connected to a connecting plug (21), the method comprising forming said annular plastic ring in said retaining groove in a circumference of said inlet end of said fuel inlet connecting piece at a time different from forming said plastic sheath to surround at least a portion of said electromagnetic valve which covers substantially the entire length of said fuel inlet connecting piece toward its inlet end, and an upper end of said plastic sheath is spaced from said annular plastic ring and in combination with said plastic annular ring forms an annular groove (25) that surrounds said inlet end, said annular groove having radially extending side surfaces formed by said upper end of said plastic sheath and said annular plastic ring.

* * * * *